United States Patent [19]

Yoshida

[11] Patent Number: 4,490,420

[45] Date of Patent: Dec. 25, 1984

[54] MEDICAL BAG AND METHOD FOR MANUFACTURING THE SAME

[75] Inventor: Takao Yoshida, Fujinomiya, Japan

[73] Assignee: Terumo Corporation, Tokyo, Japan

[21] Appl. No.: 422,943

[22] Filed: Sep. 24, 1982

[30] Foreign Application Priority Data

Mar. 24, 1982 [JP] Japan ..... 57-46779

[51] Int. Cl.[3] ..... B65D 31/02

[52] U.S. Cl. ..... 428/35; 156/289; 156/290; 156/308.4; 428/195; 428/447; 604/408

[58] Field of Search ..... 428/195, 447, 35; 604/403, 408; 156/289, 290, 308.4, 323; 383/35

[56] References Cited

U.S. PATENT DOCUMENTS

| | | | |
|---|---|---|---|
| 3,523,050 | 8/1970 | Campbell | 156/289 |
| 3,849,359 | 11/1974 | Nitzsche et al. | 428/447 |
| 4,049,873 | 9/1977 | Creasey et al. | 428/447 |
| 4,119,267 | 10/1978 | Kydonieus | 604/408 |
| 4,154,714 | 5/1979 | Hockemeyer et al. | 428/447 |
| 4,337,768 | 7/1982 | Hatada et al. | 604/408 |

*Primary Examiner*—John E. Kittle

*Attorney, Agent, or Firm*—Frishauf, Holtz, Goodman & Woodward

[57] ABSTRACT

A medical bag formed of a pair of sheets which exhibit a blocking tendency at high temperatures. A non-fluid layer of an at least partially crosslinked silicone resin is formed in the form of spots or islands on at least one of two opposing surfaces of said pair of sheets. The pair of sheets is sealed by heat sealing at parts of peripheries thereof where said resin layer is not formed.

14 Claims, 4 Drawing Figures

MEDICAL BAG AND METHOD FOR MANUFACTURING THE SAME

BACKGROUND OF THE INVENTION

I. Field of the Invention

The present invention relates to a medical bag and a method for manufacturing the same, and more particularly, to an improvement in a medical bag formed from sheets which exhibit a blocking tendency at high temperatures.

II. Description of the Prior Art

Flexible medical bags such as blood bags are currently made of soft polyvinyl chloride or polyolefin-type resins. These medical bags must be sterilized (generally sterilized by steam autoclaving) for hygiene. However, the resins as described above exhibit a blocking tendency at high temperatures during sterilization; the inner surfaces of the sheets of these resins adhere to each other. In order to solve this problem, sterilization is conventionally performed while introducing air into the bag. However, this results in poor workability.

If a blood bag is made of polyvinyl chloride, it is possible to add a substance which acts as an anticoagulant for platelets to polyvinyl chloride, and to transfer this substance to the inner and outer surfaces of the bag. However, this method does not provide sufficiently good results. Furthermore, when these measures are taken, elution of a plasticizer, which is a factor in degrading the storage characteristics of the platelets cannot be prevented. Other measures must be taken to prevent elution of the plasticizer.

SUMMARY OF THE INVENTION

It is an object of the present invention to provide a medical bag and a method for manufacturing the same, wherein blocking of the inner surfaces of sheets of the medical bag is reduced to the minimum during steam autoclaving sterilization.

It is another object of the present invention to provide a medical bag and a method for manufacturing the same wherein excellent storage characteristics of platelets are guaranteed.

In order to achieve the above and other objects of the present invention, there is provided a medical bag comprised of a pair of sheets which exhibit a blocking tendency at high temperatures, a non-fluid layer of an at least partially crosslinked silicone resin being formed in the form of spots or islands on at least one of two opposing surfaces of said pair of sheets, and said pair of sheets being sealed by heat sealing at those parts of the peripheries thereof where said non-fluid layer is not formed.

According to the present invention, the sheets are generally made of soft polyvinyl chloride or other soft plastics.

The non-fluid layer of silicone resin layer is preferably formed on both opposing surfaces of the pair of sheets.

Usually, the partially crosslinked silicone resin mainly contains alkylsiloxane units and includes an aminoalkylsiloxane-dimethylsilicane copolymer which contains, for example, 5 to 20% by weight of aminoalkylsiloxane units and 95 to 80% by weight of dimethylsiloxane units.

A medical bag of the present invention may be manufactured by preparing a pair of sheets which exhibit a blocking tendency at high temperatures, coating a reactive silicone resin solution in the form of spots or islands on one surface of the sheets, drying the resin layer to at least partially crosslink the resin to render it non-fluidized, superposing the sheets upon each other, and sealing by heat sealing those parts of the sheets where the resin layer is not formed, so as to provide a medical bag.

The resin solution may be coated by spray coating or printing.

If the sheets are made of a plastic which has a high-frequency welding property such as polyvinyl chloride, sealing is preferably performed with high-frequency waves.

DETAILED DESCRIPTION OF THE PREFERRED EMBODIMENTS

The present inventors have made extensive studies in order to solve the problem of blocking between the inner surfaces of the sheets of a medical bag during steam autoclaving sterilization. As a result of such studies, it has been found that certain types of silicone resins can prevent blocking, improve the storage characteristics of platelets, and reduce to the minimum elution of a plasticizer when soft polyvinyl chloride is used for the sheets.

A silicone resin to be used herein must be reactive and must be nontoxic to human bodies. If the bag of the present invention is used as a blood bag, the resin must also serve to prevent adhesion of platelets to the bag. Reactive silicone resins which satisfy these requirements may be easily selected from known silicone resins. Examples of such reactive silicone resins which satisfy these requirements include those which mainly contain alkylsiloxane units such as aminoalkylsiloxane-dimethylsiloxane copolymers and which are described, for example, in Japanese Patent Publication No. 46-3627. Such a copolymer contains 5 to 20% by weight of aminoalkylsiloxane units and 95 to 80% by weight of dimethylsiloxane units. Such a reactive silicone resin is commercially available in the form of a solution.

According to the present invention, the reactive silicone resin is coated on at least one of the opposing surfaces of a pair of sheets making up a bag, so as to prevent blocking and to improve the storage characteristics of platelets. However, if the reactive silicone resin is coated continuously over the entire surface of the sheet, sealing of the bag is prevented by the presence of the silicone resin, and a bag cannot be manufactured. For this reason, the silicone resin is coated in the form of small spots or islands. More specifically, the silicone resin is coated in the form of spots or islands to leave a continuous non-coated part of the sheet. The non-coated part (i.e. at the matrix portion) is then heat-sealed to provide a desired bag. The silicone resin is preferably coated on both opposing surfaces of the sheets to obtain better effects.

Figure 1A:
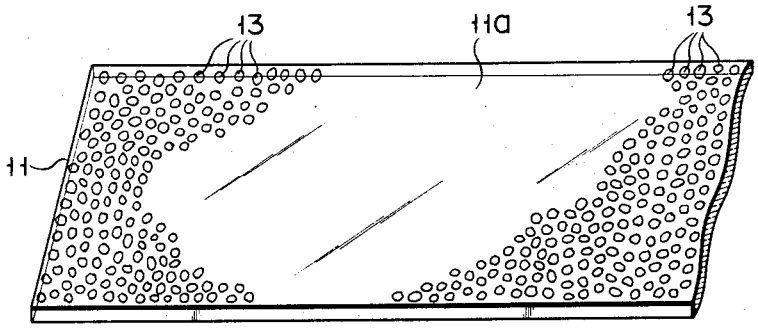
FIGS. 1A to 1C are perspective views showing in sequential order the method for manufacturing a medical bag according to the present invention.
Figure 1B:
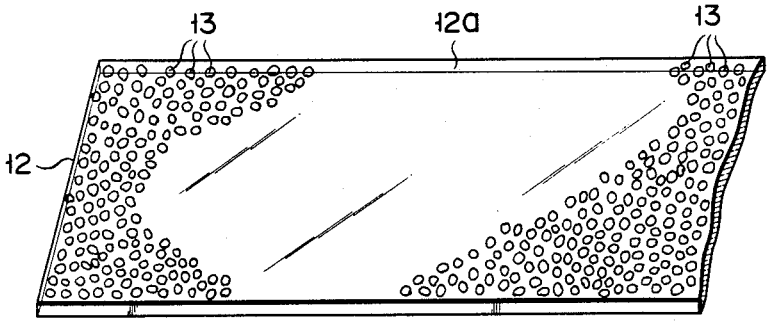

In order to manufacture a medical bag as described above, a pair of elongated sheets 11 and 12 are prepared as shown in FIGS. 1A and 1B. These elongated sheets 11 and 12 are made of a thermoplastic resin (e.g., polyvinyl chloride, or olefin-based resin such as polyethylene) and an ethylene-vinyl acetate copolymer which has a blocking tendency at high temperatures (110° to 130° C.) during steam autoclaving sterilization. Then, a reactive silicone resin solution layer 13 (partially shown) is formed in the form of separate small spots or islands on the entire surfaces 11*a* and 12*a* of sheets 11 and 12, respectively. The reactive silicone resin solution layer 13 may be formed in the form of small spots or islands by dissolving a reactive silicone resin in Freon (trade name for fluorohydrocarbon by Du Pont de Nemours) in a low concentration (e.g., 2.5%) and spraying the resultant solution, or by preparing a relatively concentrated solution and printing therewith.

Figure 1C:
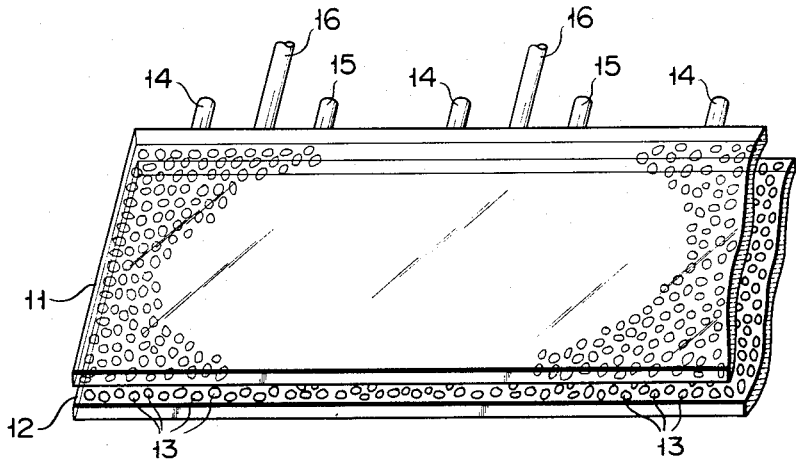

The reactive silicone resin solution layer 13 formed on each of sheets 11 and 12 is dried at room temperature (about for 15 minutes). Thereafter, the sheets 11 and 12 are superposed upon each other such that the surfaces 11*a* and 12*a* thereof oppose each other, as shown in FIG. 1C. In order to manufacture a blood bag, several sets of exhaust ports 14 and 15 and a transfusion tube 16 are inserted, with predetermined distances therebetween, between the sheets 11 and 12 in the direction perpendicular to the longitudinal direction thereof. The portions of the sheets that correspond to peripheries of the bag are then sequentially heat-sealed. Heat sealing is preferably performed with high-frequency waves if the sheets 11 and 12 are made of a plastic which has a high-frequency welding property such as polyvinyl chloride or an ethylene-vinyl acetate copolymer.

Figure 2:
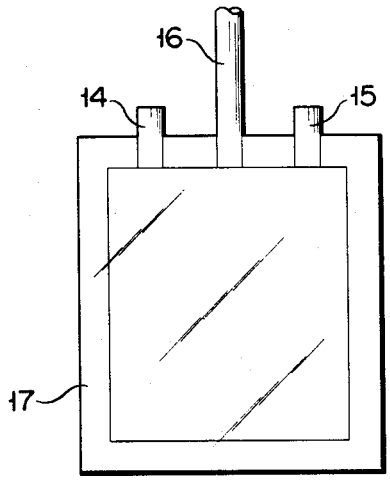
FIG. 2 is a plan view of the medical bag according to the present invention.

The sheets 11 and 12 are then cut along the sealed portion which extends perpendicularly to the longitudinal direction thereof. Thus, bags with a sealed periphery 17 is manufactured as shown in FIG. 2.

The present invention will now be described by way of its example.

EXAMPLE

A pair of sheets formed of soft polyvinyl chloride which contained dioctyl phthalate (DOP) as a plasticizer were prepared. A commercially available reactive silicone resin solution containing 50% resinous contents of aminoalkylsiloxane and dimethylsiloxane was diluted with Freon to prepare a 2.5% reactive silicone resin solution. The resin solution was then sprayed with a spray gun onto one surface of each sheet and was naturally cooled to crosslink and cure the resin. Thus, separate small spots or islands of crosslinked silicone resin were formed on the sheets (this was confirmed with a microphotograph).

The resultant sheets were superposed upon each other such that the silicone resin layers opposed each other. The peripheries of the sheets were then heat-sealed by high-frequency waves to prepare a blood collection bag.

The characteristics of the bag thus prepared were compared with those of a bag which was prepared without coating with silicone resin. The obtained results are shown in Table 1 below.

TABLE 1

| | Example | | | Comparative Example | | |
|---|---|---|---|---|---|---|
| DOP Elution Amount (in Plasma)* | 182.5 μg/ml | | | 367 μg/ml | | |
| DOP Elution Amount (in Concentrated Red Blood Corpuscles)* | 87.5 μg/ml | | | 116.2 μg/ml | | |
| Blood Platelet Adhesion** | Type I | Type II | Type III | Type I | Type II | Type III |
| | 24.6% | 50.7% | 24.7% | 11.4% | 48.6% | 40.0% |
| Blood Platelet Elongation** | | | | | | |
| High-Frequency Sealing Strength | 4.5 kg/cm | | | 4.7 kg/cm | | |
| Blocking Tendency*** | 46 g/2 cm (width) | | | 598 g/2 cm (width) | | |

Note:
*Measurements were made after leaving the plasma and concentrated red blood corpuscles to stand for 24 hours after sampling.
**Measurements were made according to the procedures in p. 478, Section 3, Blood Test (Platelet Elongation Test), "Clinical Test Technique", 1972. Types I, II and III were classified according to "Reaction of Platelets on Surfaces of Polymeric Materials for Medical Purposes", pp. 228 to 231, "Artificial Organs", 9(1), 1981.
***Measurements were made after leaving to stand in an autoclave at 121° C. for 30 minutes.

No elution of the silicone resin into plasma or concentrated red blood corpuscles was observed.

The medical bag of the present invention is comprised of a pair of sheets of a plastic which exhibits a blocking tendency at high temperatures during steam autoclaving sterilization. However, since layers of at least partially crosslinked reactive silicone resin are formed on the inner surfaces of the bag, the inner surfaces of the bag may not adhere to each other.

Since the silicone resin layers prevent adhesion or elongation of the platelets, the storage characteristics of the platelets are improved when the medical bag is used as a blood bag. Particularly if the sheets are made of soft polyvinyl chloride, the silicone resin serves to prevent elution of the plasticizer, providing an excellent blood bag.

The silicone resin may not elute into the infusion solution or into blood, thus providing a safe medical bag.

Since the silicone resin layers are formed in the form of spots or islands, heat sealability is substantially equivalent to that obtained when the resin layers are not formed. Therefore, manufacture of the bag is easy. Since the resin layers are non-fluid, handling during manufacture is easy.

What is claimed is:

1. A medical bag comprising:

a pair of sheets which exhibit a blocking tendency at high temperatures, each of said pair of sheets having a peripheral region for heat sealing said sheets to each other; and a discontinuous layer of separate small spots of a non-fluid, at least partially crosslinked silicone resin on at least one of two opposing surfaces of said pair of sheets including said peripheral region, and said pair of sheets being sealed to each other by heat sealing in the area of the peripheral region thereof which is not covered by said silicone resin.

2. The bag of claim 1, wherein said sheets are made of soft polyvinyl chloride.

3. The bag of claim 1, wherein said discontinuous resin layer is formed on each of the two opposing surfaces of said pair of sheets.

4. The bag of any one of claims 1 to 3, wherein the non-fluid silicone resin comprises mainly units of alkylsiloxane.

5. The bag of claim 4, wherein the silicone resin is an aminoalkylsiloxane-dimethylsiloxane copolymer.

6. The bag of claim 5, wherein the silicon resin contains 5 to 20% by weight of aminoalkylsiloxane units and 95 to 80% by weight of dimethylsiloxane units.

7. A medical bag comprising:

a pair of sheets which exhibit a blocking tendency at high temperatures, each of said pair of sheets having a peripheral region for heat sealing said sheets to each other; and a discontinuous layer of separate small spots of a non-fluid, at least partially crosslinked silicone resin containing 5 to 20% by weight of aminoalkylsiloxane units and 95 to 80% by weight of dimethylsiloxane units on at least one of two opposing surfaces of said pair of sheets including said peripheral region, and said pair of sheets being sealed to each other by heat sealing in the area of the peripheral region thereof which is not covered by said silicone resin.

8. A method for manufacturing a medical bag comprising:

applying separate, small spots of a reactive silicone resin solution on at least one of two opposing surfaces of a pair of sheets wherein said at least one of two opposing surfaces has an area covered by said resin solution and an area which is not covered by said resin solution, said sheets exhibiting a blocking tendency at high temperatures, each of said pair of sheets having a peripheral region for heat sealing said sheets to each other;

drying said resin solution to form a non-fluid, at least partially crosslinked resin on said at least one opposing surface thereby forming a discontinuous layer of said non-fluid, at least partially crosslinked resin;

superposing said pair of sheets upon each other so that said respective peripheral regions are in alignment with each other, and heat sealing the respective regions of said superposed pair of sheets in the area of the peripheral regions which are not covered by said resin, so as to provide said medical bag.

9. The method of claim 8, wherein said resin solution is applied by spraying or printing.

10. The method of claim 8 or 9, wherein said resin solution is applied to each of said opposed surfaces of said pair of sheets.

11. The method of claim 8, wherein said sheets are made of polyvinyl chloride and heat sealing is performed by high-frequency welding.

12. The method of claim 8, wherein said resin is an aminoalkylsiloxane-dimethylsiloxane copolymer.

13. The method of claim 12, wherein said resin contains 5 to 20% by weight of aminoalkylsiloxane units and 95 to 80% by weight of dimethylsiloxane units.

14. A method for manufacturing a medical bag comprising:

applying separate, small spots of a reactive silicone resin solution containing 5 to 20% by weight of aminoalkylsiloxane units and 95 to 80% by weight of dimethylsiloxane units on at least one of two opposing surfaces of a pair of sheets wherein said at least one of two opposing surfaces has an area covered by said resin solution and an area which is not covered by said resin solution, said sheets exhibiting a blocking tendency at high temperatures, each of said pair of sheets having a peripheral region for heat sealing said sheets to each other;

drying said resin solution to form a non-fluid, at least partially crosslinked resin on said at least one opposing surface thereby forming a discontinuous layer of said non-fluid, at least partially crosslinked resin;

superposing said pair of sheets upon each other so that said respective peripheral regions are in alignment with each other, and heat sealing the respective regions of said superposed pair of sheets in the area of the peripheral regions which are not covered by said resin, so as to provide said medical bag.

* * * * *